US005190481A

United States Patent [19]

Ju

[11] Patent Number: 5,190,481

[45] Date of Patent: Mar. 2, 1993

[54] STRUCTURE OF THE SWITCHING DEVICE FOR ELECTRICAL CONNECTOR

[76] Inventor: Ted Ju, 18, Lane 30, Syh Wei Rd., Wu Gu Hsiang, Taipei Hsien, Taiwan

[21] Appl. No.: 490,707

[22] Filed: Mar. 7, 1990

[51] Int. Cl.[5] ..... H01R 27/02

[52] U.S. Cl. ..... 439/654; 439/752

[58] Field of Search ..... 439/635-655, 439/695, 696, 701, 686, 752, 731, 723, 733

[56] References Cited

U.S. PATENT DOCUMENTS

| | | | |
|---|---|---|---|
| 3,005,179 | 10/1961 | Holt | 439/652 |
| 3,123,428 | 3/1964 | McKee | 439/651 |
| 3,945,705 | 3/1976 | Seim et al. | 439/752 |
| 4,781,625 | 11/1988 | Yang | 439/654 |

FOREIGN PATENT DOCUMENTS

| | | | |
|---|---|---|---|
| 0652241 | 10/1985 | Switzerland | 439/701 |

*Primary Examiner*—David L. Pirlot

*Attorney, Agent, or Firm*—Wenderoth, Lind & Ponack

[57] ABSTRACT

An electrical connector includes a plurality of terminals, each of the terminals configured of a flat connecting plate defining a first plane and first and second connecting heads extending from opposing edges of the connecting plate. First and second insulating bodies are provided having confronting first and second generally flat surfaces defining a second plane which is substantially perpendicular to the first plane. Each of the insulating bodies has a plurality of grooves formed therein for receiving one of the connecting heads and a portion of the flat connecting plate of each of the plurality of terminals. Through-holes are provided in each of the first and second insulating bodies which extend from the grooves to an outer surface of each of the insulating bodies.

8 Claims, 2 Drawing Sheets

STRUCTURE OF THE SWITCHING DEVICE FOR ELECTRICAL CONNECTOR

BACKGROUND OF THE INVENTION (a) Field of the Invention

This invention relates to an improved structure of a switching device for an electrical connector, and more particularly, to such a structure which can considerably reduce relative size, simplify the production process and lower the manufacturing cost. According to this invention, a plurality of terminals used in the conventional switching devices have been improved, each of them being formed of a thin laminate by press work, having a connecting plate as the central portion thereof and two connecting heads arranged at the opposite sides of the connecting plate in a staggered and parallel manner, the connecting plate and the two connecting heads are longitudinally connected together. Based on the thickness of the connecting plate, a plurality of grooves are formed in two plastic members respectively for inserting the connecting plate therein. As a result, the two plastic members are more compact, and the insulating walls between each two adjacent terminals are relatively thick to enhance the insulation effect.

(b) Description of the Prior Art

The application of the electrical connector in general is very extensive. However, the electrical connector is generally divided into male and female portions according to the type of connection, and there is no specific restriction of a standard in the adoption for various instruments. Under such circumstances, the utilization of an adapter is required to achieve the effect of connecting and switching. The most conventional manner for achieving an electrical connector is to solder the terminals on two separate connecting blocks with wire, and then to coat the result with materials, such as insulating plastics, for which the manufacturing process is very complicated and difficult, resulting in higher costs, reduced production capacity, and, due to the sophisticated internal wiring, a variety of errors. Therefore, the price of the single direction switching device is expensive and is difficult to promote and market.

Recently there has been developed a type of switching device formed by using two plastic members to engage a plurality of terminals therein, which is easier to assemble, smaller in size and lower in manufacturing costs. On the other hand, the examples as disclosed in U.S. Pat. Nos. 4,618,196, 4,781,625, Switz. Pat. No. 0,366,872, and CCCP. Pat. No. 0,645,227 are improvements on the switching device for electrical connector. However, it is found that all the prior art terminals are first made of a thin laminate by press work into a lengthy strip form (refer to FIG. 1), then the connecting plate 1 as the central portion thereof, is bent manually to form two connecting heads in a staggered and parallel arrangement, and finally the terminals of such a design are inserted into the terminal holes of the plastic members. As the prior art terminals are manufactured in such a way as above mentioned, when the terminals are inserted into the plastic members, the horizontal space occupied by the connecting plate 1 therein is subject to the width of connecting plate 1 (not its thickness). Since such a width must bear quite a large bending force, and in view of the insertion force caused during the insertion process of terminal into the terminal holes, it is not advisable to have it shaped too narrow. In this case, the number of terminals to be arranged in the plastic members is limited. Further, since the bending work with respect to the connecting plate is done manually, it is both time and labor consuming, and very uneconomical. Moreover, since the connecting plate 1 occupies a certain space horizontally, which makes the whole switching device unable to be efficiently reduced in size and it is thereby impossible to increase the spacing between each two adjacent terminals, thus resulting in unsatisfactory insulating dffect.

SUMMARY OF THE INVENTION

The primary object of the present invention is to provide an improved structure of the switching device for the electrical connector, in which the connecting plate of the terminal is made in a thin laminate form and is connected with two connecting heads longitudinally, so as to efficiently reduce the horizontal space occupied in the plastic members and increase the relative thickness of the insulating walls between each two adjacent terminal holes to obtain a better and safer insulation effect. The result is a considerable reduction in size of the entire switching device, providing the advantages of compactness and convenience in practical applications.

Another object of the present invention is to make it possible for the terminals of the switching device to be totally and rapidly formed by machine, so as to shorten the manufacturing time, increase the production capacity, lower the labor expense and generally cut down costs.

DETAILED DESCRIPTION OF THE PREFERRED EMBODIMENT

Figure 1:
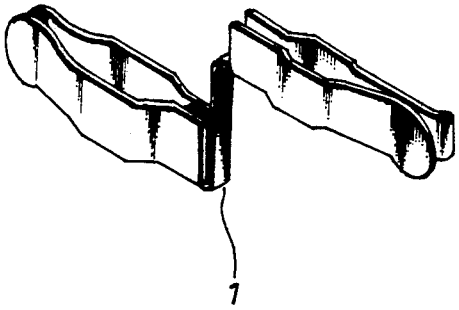
FIG. 1 is a perspective view of the conventional terminal.
Figure 2:
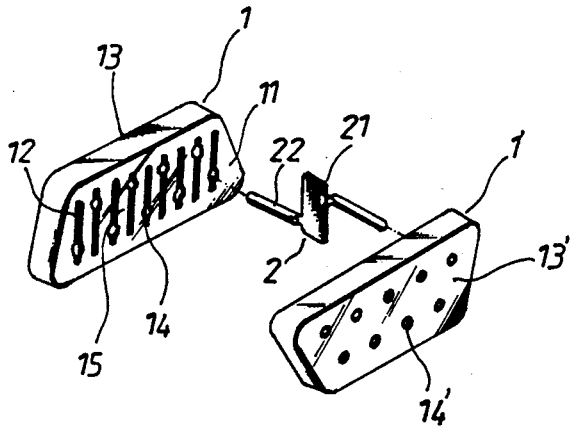
FIG. 2 is an exploded perspective view showing an embodiment of a female terminal according to the present invention.
Figure 3:
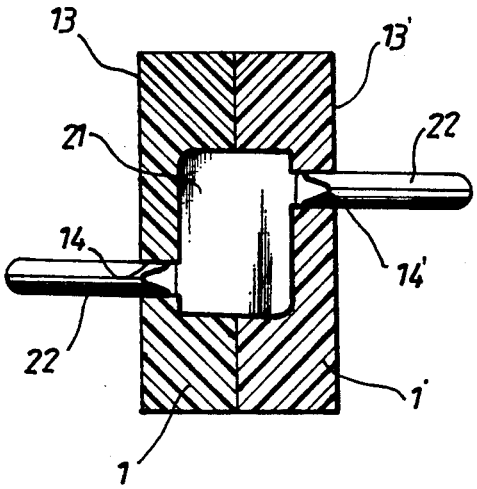
FIG. 3 is a vertical-sectional view of the embodiment shown in FIG. 2.
Figure 4:
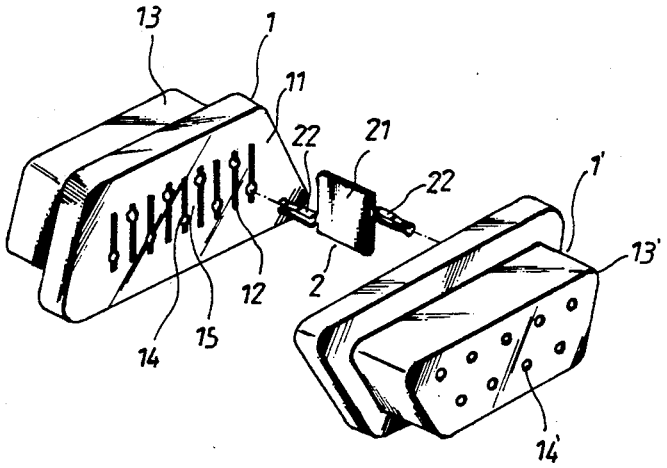
FIG. 4 is an exploded perspective view showing an embodiment of a male terminal according to the present invention.
Figure 5:
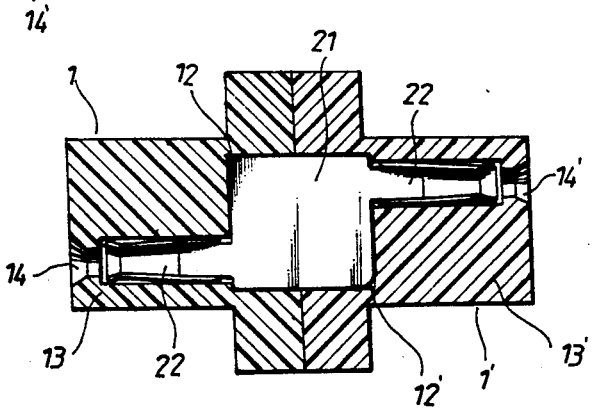
FIG. 5 is an vertical sectional view of the embodiment shown in FIG. 4.
Figure 6:
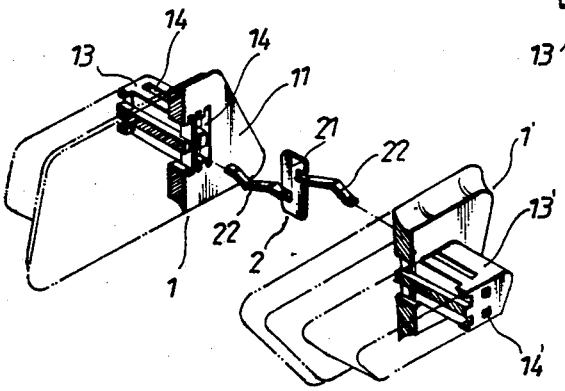
FIG. 6 is an exploded perspective view showing an embodiment of a flexible sheet type male terminal according to the present invention.
Figure 7:
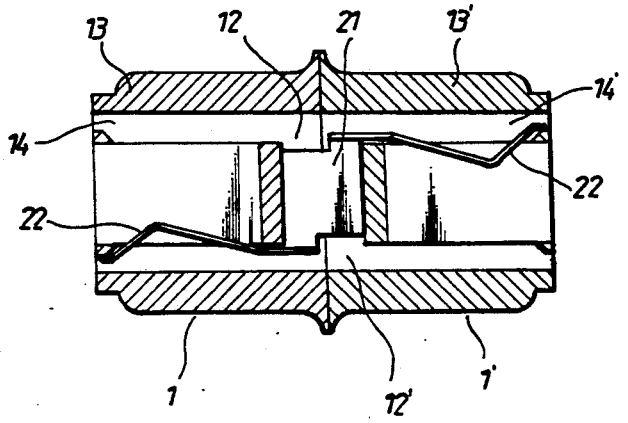
FIG. 7 is an vertical sectional view showing an embodiment of a flexible sheet type female terminal according to the present invention.

Referring to FIGS. 2 to 7, the present invention comprises two plastic members 1, 1' and a plurality of terminals 2. Each terminal 2 is made in a thin laminate form by press work and includes a connecting plate 21 as the central portion thereof and two connecting heads 22 arranged at opposite sides of the connecting plate 21 in a staggered and parallel manner. The connecting plate 21 is disposed in a longitudinal and vertical manner according its original thickness;

The fitting surfaces 11, 11' of the two plastic members 1, 1' provide the grooves 12, 12' as per the thickness of connecting plate 21 so as to receive the connection plate 21 into the grooves 12, 12', and the other sides of the two plastic 1, 1' include terminal holes 14, 14' according to the type of connecting head 22.

For the engagement of the terminal 2 and the plastic members 1, 1', the connecting heads 22 are inserted into the terminal holes 14, 14' of the plastic members 1, 1' respectively and the connecting plate 21 is fitted into the grooves 12, 12' longitudinally. In such a manner, the space horizontally occupied by the connecting plate 21 is determined its thickness, which is significantly smaller than the space horizontally occupied by the conventional connecting plate. As a result, the insulating portions 15, 15' between two adjacent grooves 12, 12' is relatively increased in thickness so as to enhance the insulation effect. Further, it is possible to arrange the terminals 2 at a narrower spacing between each other, thus substantially reducing the overall size of the switching device. Moreover, since the connecting plate 21 is put in place in a longitudinal and vertical arrangement, a sufficient force is produced to resist the longitudinal pushing and pulling forces caused during the insertion of the terminals 2 into the terminal holes 14, 14', thus eliminating the possibility that the will become weak as in the conventional connectors. The terminal designed according to the present invention can be manufactured by press work in a single process, the size of the switching device can be considerably decreased, and the insulation effect can be enhanced when compared to the conventional terminal. In addition, there is no need to bend the connecting plate 21 during the manufacture, so as to save the labor cost and expedite the production run.

As shown in FIGS. 2 to 7, the terminal 2 the present invention is characterized in that the connecting plate 21 is designed to be in a thin laminate form longitudinally, whereas the design of the connecting heads 22 is variable according to the usage of the terminal (shown in the accompanying drawings are the male and female terminals of the conventional type and flexible sheet type respectively), but all such and similar variations and modifications should be within the scope of the present invention.

I claim:

1. A connector comprising:

a plurality of terminals, each of said plurality of terminals comprising a substantially flat connecting plate defining a first plane and first and second connecting heads extending from opposing edges of the substantially flat connecting plate, said first and second connecting heads having respective axes extending parallel to the first plane and parallel to each other; and, first and second insulating bodies respectively having confronting first and second generally flat surfaces defining a second plane therebetween which is substantially perpendicular to the first plane, said first insulating body having a first plurality of grooves, formed in said first generally flat surface, each for receiving said first connecting head and a first portion of said substantially flat connecting plate one of said plurality of terminals, said second insulating body having a second plurality of grooves, confronting said first plurality of grooves and formed in said second generally flat surface, each for receiving said second connecting head and a remaining second portion of said substantially flat connecting plate of one of said plurality of terminals;

said first insulating body having a third generally flat surface opposing said first generally flat surface and a first plurality of through-holes extending respectively from said first plurality of grooves to said third generally flat surface, each of said first plurality of through-holes for receiving one of said first connecting heads, said second insulating body having a fourth generally flat surface opposing said second generally flat surface and a second plurality of through-holes extending respectively from said second plurality of grooves to said fourth generally flat surface, each of said second plurality of through-holes for receiving one of said second connecting heads.

2. A connector as recited in claim 1, each of said first and second connecting heads configured as a male connection terminal.

3. A connector as recited in claim 1, each of said first and second connecting heads configured as a female connection terminal.

4. A connector as recited in claim 1, said first and second connecting heads configured respectively as a male connection terminal and a female connection terminal.

5. A connector as recited in claim 1, each of said plurality of terminals being formed of a thin metallic laminate.

6. A connector as recited in claim 5, each of said first and second connecting heads configured as a male connection terminal.

7. A connector as recited in claim 5, each of said first and second connecting heads configured as a female connection terminal.

8. A connector as recited in claim 5, said first and second connecting heads configured respectively as a male connection terminal and a female connection terminal.

* * * * *